US009164440B2

(12) United States Patent
Kimoto

(10) Patent No.: US 9,164,440 B2
(45) Date of Patent: Oct. 20, 2015

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventor: Taizo Kimoto, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/014,052

(22) Filed: Aug. 29, 2013

(65) Prior Publication Data

US 2014/0193168 A1 Jul. 10, 2014

(30) Foreign Application Priority Data

Jan. 9, 2013 (JP) ..... 2013-001531

(51) Int. Cl.
*G03G 15/20* (2006.01)

(52) U.S. Cl.
CPC ..... *G03G 15/205* (2013.01); *G03G 15/2078* (2013.01); *G03G 2215/209* (2013.01)

(58) Field of Classification Search
CPC ..... G03G 15/2039; G03G 15/205; G03G 15/2078; G03G 2215/209
USPC ..... 399/69, 70, 85
See application file for complete search history.

(56) References Cited

U.S. PATENT DOCUMENTS

| | | | | | |
|---|---|---|---|---|---|
| 5,073,799 | A * | 12/1991 | Watanabe | ..... | 399/70 |
| 5,394,231 | A * | 2/1995 | Sudo et al. | ..... | 399/228 |
| 2006/0251432 | A1* | 11/2006 | Shibata | ..... | 399/44 |
| 2009/0297199 | A1* | 12/2009 | Yamashina et al. | ..... | 399/70 |
| 2011/0318038 | A1* | 12/2011 | Yoshizumi | ..... | 399/69 |

FOREIGN PATENT DOCUMENTS

| | | | | | |
|---|---|---|---|---|---|
| JP | H04287080 | A | | 10/1992 | |
| JP | H06095494 | A | | 4/1994 | |
| JP | H07077890 | A | | 3/1995 | |
| JP | 2000356870 | A | * | 12/2000 | ..... G03G 15/00 |
| JP | 2008-034922 | A | | 2/2008 | |
| JP | 2009103986 | A | | 5/2009 | |
| JP | 2012-140005 | A | | 7/2012 | |

OTHER PUBLICATIONS

Japanese Office Action dated Dec. 9, 2014, filed in Japanese counterpart Application No. 2013-001531, 7 pages (with translation).
Japanese Office Action dated Aug. 4, 2015, filed in Japanese counterpart Application No. 2013-001531, 7 pages (with translation).

* cited by examiner

*Primary Examiner* — Benjamin Schmitt
(74) *Attorney, Agent, or Firm* — Patterson & Sheridan, LLP

(57) ABSTRACT

An image forming apparatus includes a fixing unit that fixes an image of a toner using any one of a first toner and a second toner on a recording medium, and a control unit that sets a fixing temperature and a standby temperature of the fixing unit. The control unit sets the fixing temperature when the image of the first toner is fixed to a first temperature, sets the fixing temperature when the image of the second toner is fixed to a second temperature lower than the first temperature, and sets the standby temperature when the fixing unit is in a standby state to a temperature closer than the second temperature than the first temperature.

6 Claims, 9 Drawing Sheets

| TONER | FIXING TEMPERATURE | STANDBY TEMPERATURE |
|---|---|---|
| X | １２０℃ | １２０℃ |
| K | １６０℃ | |

Fig.3

| TONER | FIXING TEMPERATURE | STANDBY TEMPERATURE |
|---|---|---|
| X | 120℃ | 120℃ |
| K | 160℃ | |
| C | 160℃ | |
| M | 160℃ | |
| Y | 160℃ | |

Fig.9

IMAGE FORMING APPARATUS

CROSS-REFERENCE TO RELATED APPLICATION

This application is based upon and claims the benefit of priority from the prior Japanese Patent Application No. 2013-1531, filed on Jan. 9, 2013, the entire contents of which are incorporated herein by reference.

FIELD

Embodiments described herein relate generally to an image forming apparatus which forms an image on a recording medium.

BACKGROUND

An electro photographic image forming apparatus has been known. The image forming apparatus heats a toner, which is a colorant, at a predetermined temperature (hereinafter, referred to as a fixing temperature) to fix an image of the toner on a recording medium (for example, a sheet). The image forming apparatus forms an image by the fixing operation. The image forming apparatus includes a fixing unit that fixes an image of the toner on the recording medium. The image forming apparatus has a warming-up mode, a standby mode, and a printing mode, as operation modes. The image forming apparatus controls a temperature of the fixing unit according to each operation mode. The warming-up mode is an operation mode when the image forming apparatus is powered on. The image forming apparatus in the warming-up mode controls the temperature of the fixing unit to raise the temperature of the fixing unit to a predetermined target temperature. The target temperature of the warming-up mode is, for example, a temperature close to the fixing temperature. The standby mode is an operation mode when an image forming operation is not performed after the fixing unit reaches the target temperature. The image forming apparatus in the standby mode controls the temperature of the fixing unit to keep the temperature of the fixing unit at a standby temperature. The standby temperature is, for example, the same temperature as the target temperature. The printing mode is an operation mode when the image forming apparatus is forming an image. The image forming apparatus in the printing mode controls the temperature of the fixing unit to raise the temperature of the fixing unit from the standby temperature to the fixing temperature and to keep the temperature of the fixing unit at the fixing temperature.

As the image forming apparatus, an image forming apparatus using a plurality of toners is known. For example, a color image forming apparatus is provided with four colors (black K/cyan C/magenta M/yellow Y) of toners. The color image forming apparatus forms a color image using four colors of toners. The fixing unit heats four colors of toners at the fixing temperature to fix the image of the toners on the recording medium (for example, a sheet). Fixing temperature characteristics of the toners are different according to kinds of toners. Accordingly, the temperatures necessary for fixing of the toners are different according to kinds of toners. However, the fixing temperature of the color image forming apparatus may be changed by an environmental temperature, but is not changed by kinds of toners to be used. The target temperature of the warming-up mode and the standby temperature of the standby mode in the color image forming apparatus are also not changed by kinds of toners. The reason why the fixing temperature is not changed is that four colors of toners are simultaneously fixing targets in a case of color image formation.

Meanwhile, as the image forming apparatus using the plurality of toners, an image forming apparatus provided with two kinds of toners, that is, a color erasable toner (hereinafter, referred to as an erasable toner) and a color inerasable toner is proposed. In a case of the image forming apparatus, since an image is formed using any one toner, two kinds of toners are not simultaneously the fixing targets. Accordingly, the image forming apparatus changes the fixing temperature of the fixing unit according to the kind of toner to be used. In this case, to achieve image formation using any toner between two kinds of toners, the image forming apparatus sets the target temperature (=the standby temperature) of the warming-up mode to the higher fixing temperature of the fixing temperatures of two kinds of toners.

However, in a case of forming an image using a toner with a low fixing temperature (for example, an erasable toner), since the fixing temperature of the erasable toner is lower than the standby temperature, the image forming apparatus has to lower the temperature of the fixing unit from the standby temperature to the fixing temperature of the erasable toner. A conventional fixing unit has a configuration for heating but does not have a configuration only for cooling. For this reason, generally, a time necessary to lower the temperature of the fixing unit is longer than a time necessary to raise the temperature of the fixing unit. Accordingly, the image forming apparatus provided with the erasable toner and a normal toner imposes an unnecessary standby time on the user when an image is formed using the toner with the low fixing temperature.

BRIEF DESCRIPTION OF THE DRAWINGS

FIG. 3 is a diagram illustrating a relation between a fixing temperature and a standby temperature of a fixing unit in a printing mode according to the first embodiment;

FIG. 9 is a diagram illustrating a relation between a fixing temperature and a standby temperature of a fixing unit in a printing mode according to the third embodiment.

DETAILED DESCRIPTION

According to an embodiment, an image forming apparatus includes an operation unit, an image forming unit, a fixing unit, and a control unit. The operation unit receives an instruction of an image forming operation. The image forming unit accommodates a first toner and a second toner, and forms an image of a toner on a recording medium using any one toner of the first toner and the second toner when the instruction of the image forming operation is received by the operation unit. The fixing unit fixes the image of the toner formed by the image forming unit on the recording medium at a fixing temperature and waits at a standby temperature when the instruction of the image forming operation is not received by the operation unit. The control unit sets the fixing temperature when the image of the first toner is fixed, to a first temperature and sets the fixing temperature when the image of the second toner is fixed, to a second temperature lower than the first temperature. The control unit further sets the standby temperature when the fixing unit is in a standby state, to a temperature closer to the second temperature than the first temperature, to control the fixing unit.

Figure 1:
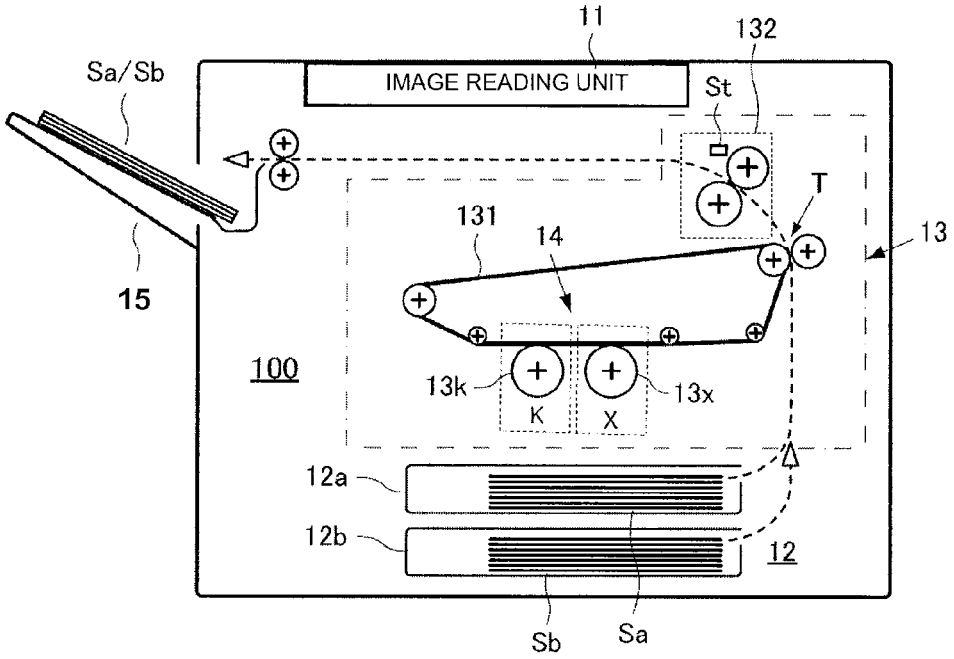
FIG. 1 is a diagram illustrating an image forming apparatus according to a first embodiment.
Figure 2:
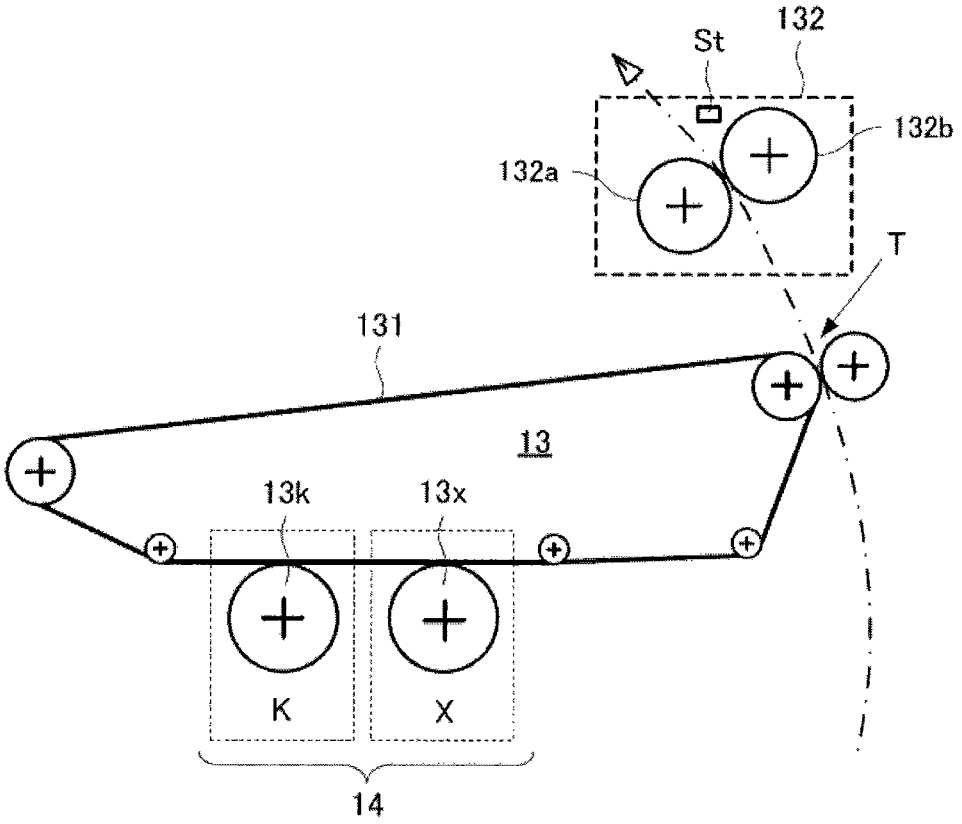
FIG. 2 is an enlarged diagram illustrating a part of the imaging forming apparatus according to the first embodiment.

Hereinafter, embodiments will be further described with reference to the drawings. In the drawings, the same signs represent the same or similar portions. FIG. 1 is a diagram illustrating an image forming apparatus according to a first embodiment. FIG. 2 is an enlarged diagram illustrating a part of the image forming apparatus according to the first embodiment. The image forming apparatus is a digital multi-function peripheral (MFP) 100 that forms an image on a recording medium (for example, a sheet) using electro photography.

The MFP 100 is provided with a color erasable colorant, for example, a toner X, and a color inerasable colorant, for example, a normal toner K. The MFP 100 forms an image on a recording medium, for example, a sheet, using any one of the erasable toner X and the normal toner K. A user designates whether to use the erasable toner X or the normal toner K by an operation unit 45 to be described later.

The erasable toner X has, for example, a characteristic in which a color of the toner is erased by a chemical reaction when it is heated at a predetermined temperature. A fixing temperature of the erasable toner X to be described later is lower than a fixing temperature of the normal toner K. The sheet on which the image is printed using the erasable toner X is heated to erase the color of the toner, which can be reused.

The MFP 100 can be connected to other devices such as a client terminal through a network (not illustrated). The client terminal may be a desktop, mobile, or tablet computer connected through the network. The client terminal may be a mobile terminal such as a smartphone, and may have a configuration connected to the MFP 100 by radio communication.

The MFP 100 includes an image reading unit 11, a sheet supply unit 12 that supplies a printing sheet, an image forming unit 13, and a sheet discharge unit 15. In addition, although not illustrated, the MFP 100 includes an exposure unit and the like. The image reading unit 11 is a general image reading device provided in a copy machine, an image scanner, or the like. The image reading unit 11 optically scans an original to read an image of the original, and obtains image data of the original. The image reading unit 11 is operated when the MFP 100 copies the original and scans the original to be computerized.

The sheet supply unit 12 includes a non-used sheet supply unit 12*a* that accommodates a non-used sheet Sa and supplies the non-used sheet Sa to the image forming unit 13. The sheet supply unit 12 further includes a reused sheet supply unit 12*b* that accommodates a reused sheet Sb and supplies the reused sheet Sb to the image forming unit 13. The non-used sheet Sa is a sheet having no history in which an image was printed in the past. The non-used sheet Sa may be, for example, a sheet of which one face has an image printed thereon and the other face has no printing history. The reused sheet Sb is a sheet having a printing history. Specifically, the reused sheet Sb is a sheet on which an image was printed using the erasable toner in the past but a color of the image (the image of the toner) is erased, for example, by heating.

The control unit 41 selects the sheet supply units 12*a* and 12*b* according to the toner designated by the user through the operation unit 45. Specifically, when the user designates the erasable toner X through the operation unit 45, the control unit 41 selects the sheet supply unit 12*b* and controls the sheet supply unit 12*b* to supply the reused sheet Sb to the image forming unit 13. When the user designates the normal toner K through the operation unit 45, the control unit 41 selects the sheet supply unit 12*a* and controls the sheet supply unit 12*a* to supply the non-used sheet Sa to the image forming unit 13. The selection between the sheet supply unit 12*a* and 12*b* is not limited to the above description. For example, apart from the designation of the toner, the user may select the sheet supply units 12*a* and 12*b* through the operation unit 45. The sheet supply unit 12 may be provided with a manual sheet supply unit (not illustrated).

The image forming unit 13 is a unit that forms an image by general electro photography, and includes, for example, a process unit 14. The process unit 14 includes a normal toner process unit and an erasable toner process unit. The normal toner process unit 14 includes a normal toner photoreceptor drum 13*k*. The erasable toner process unit 14 includes an erasable toner photoreceptor drum 13*x*. The image forming unit 13 forms an electrostatic latent image on the photoreceptor drum 13*k* or the photoreceptor drum 13*x* based on image data obtained by a device such as the image reading unit 11 or the client terminal connected to the MFP 100 through the network.

The normal toner process unit 14 includes an accommodation unit that accommodates the normal toner K. The normal toner process unit 14 includes a normal toner developing device (not illustrated), and supplies the normal toner K to the normal toner developing device. The normal toner developing device develops the electrostatic latent image of the photoreceptor drum 13*k*, and forms an image of the normal toner K actualized on the photoreceptor drum 13*k*.

The erasable toner process unit 14 includes an accommodation unit that accommodates the erasable toner X. The erasable toner process unit 14 includes an erasable toner developing device (not illustrated), and supplies the erasable toner X to the erasable toner developing device. The erasable toner developing device develops the electrostatic latent image of the photoreceptor drum 13*x*, and forms an image of the actualized erasable toner X. The image formation of the erasable toner on the photoreceptor drum 13*x* and the image formation of the normal toner on the photoreceptor drum 13*k* are not simultaneously performed.

The normal toner process unit 14 and the erasable toner process unit 14 may be installed in and removed from the MFP 100 by the user. Each of the normal toner process unit 14 and the erasable toner process unit 14 stores unique authentication data. The process unit 14 includes a storage unit for storing the authentication data, for example, an IC chip.

The process unit 14 configures the accommodation unit that accommodates the toner as an individual unit (hereinafter, referred to as a toner cartridge), and the toner cartridge may be configured to be installed and removed by the user. When the toner accommodation unit is the toner cartridge, the toner cartridge includes an IC chip for storing the authentication data.

The image forming unit 13 includes a transfer belt 131. The image forming unit 13 temporarily transfers the image of the normal toner K formed on the photoreceptor drum 13*k* or the image of the erasable toner X formed on the photoreceptor drum 13*x* onto the transfer belt 131. The image forming unit 13 transfers the image of the toner of the transfer belt 131 onto the sheet Sa or Sb supplied from the sheet supply unit 12 at a transfer position T.

The sheet discharge unit 15 accumulates the discharged sheet on which the image of the toner is fixed by a fixing unit 132 to be described later. The sheet discharge unit 15 accumulates together the sheet Sa printed by the normal toner K and the sheet Sb printed by the erasable toner X. The sheet discharge unit 15 may be configured to accumulate the sheet Sa and the sheet Sb, separately.

The MFP 100 further includes the fixing unit 132. The fixing unit 132 includes a heat roller 132*a* having a heater as a heating source. The fixing unit 132 further includes a press roller 132*b* pressed onto the heat roller 132*a*. The fixing unit 132 fixes the image of the toner on the sheet by the heat of the heat roller 132*a* and the pressure of the press roller 132*b*. The configuration of the fixing unit 132 is not limited to the above description. For example, the press roller 132*b* may include a heater. The heating source of the heat roller 132*a* is not limited to the heater. The heating source of the heat roller 132*a* may be an induction heating coil.

The MFP 100 controls a temperature of the heat roller 132*a* of the fixing unit 132 (hereinafter, merely referred to as the fixing unit 132) by the operation mode. The MFP 100 has a warming-up mode, a standby mode, and a printing mode, as the operation mode. The warming-up mode is an operation mode of the MFP 100 when the user powers on the MFP 100.

The MFP 100 in the warming-up mode controls the temperature of the fixing unit 132 to raise the temperature of the fixing unit 132 to the target temperature. The target temperature of the warming-up mode in the first embodiment is the same temperature as the fixing temperature of the erasable toner X as will be described later.

The standby mode is an operation mode of the MFP 100 when the fixing unit 132 reaches the target temperature and then the MFP 100 does not perform the image forming operation. The MFP 100 of the standby mode controls the temperature of the fixing unit 132 to keep the temperature of the fixing unit 132 at the standby temperature. Accordingly, the fixing unit 132 waits at the standby temperature until the operation unit 45 to be described later receives an image formation instruction by the user. The standby temperature is the same temperature as the target temperature.

The printing mode is an operation mode of the MFP 100 when the MFP 100 is forming an image. The MFP 100 in the printing mode controls the temperature of the fixing unit 132 to raise the temperature of the fixing unit 132 from the standby temperature to the fixing temperature and to keep the temperature of the fixing unit 132 at the fixing temperature.

Specifically, in the warming-up mode, the MFP 100 turns on the heater of the heat roller 132*a* to heat the heat roller 132*a* to raise the temperature of the heat roller 132*a* to the target temperature (=the standby temperature). In the standby mode, the MFP 100 turns on and off the heater to keep the temperature of the heat roller 132*a* raised to the standby temperature Tat the standby temperature. In the printing mode, the MFP 100 turns on and off the heater to raise the temperature of the heat roller 132*a* to the fixing temperature equal to or higher than the standby temperature and to keep it at the fixing temperature. The fixing unit 132 includes a temperature sensor St that detects the temperature of the heat roller 132*a* to raise the temperature of the heat roller 132*a* to the target temperature, the standby temperature, or the fixing temperature and to keep it at the temperature.

Generally, the fixing temperature characteristic of the toner is different according to the kind thereof. Accordingly, the temperature necessary to fix the toner is different according to the kind of toner. The normal toner K and the erasable toner X have the different fixing temperature characteristics, and thus the temperatures necessary for fixing are different. The fixing temperature of the fixing unit 132 when an image is printed using the normal toner K is a temperature (hereinafter, referred to as a fixing temperature TK) determined based on the temperature necessary for the fixing of the normal toner K. The fixing temperature of the fixing unit 132 when an image is printed using the erasable toner X is a temperature (hereinafter, referred to as a fixing temperature TX) determined based on the temperature necessary for the fixing of the erasable toner. X. The fixing temperature TX is a temperature different from the fixing temperature TK.

The standby temperature of the fixing unit 132 of the first embodiment (=the target temperature of the fixing unit 132 in the warming-up mode) is the same temperature as the lower fixing temperature between the fixing temperature TK and the fixing temperature TX. FIG. 3 illustrates a relation between the fixing temperature in the printing mode of the first embodiment and the standby temperature (=the target temperature of the fixing unit 132 in the warming-up mode). As illustrated in FIG. 3, the fixing temperature TK of the normal toner K is 160° C., and the fixing temperature TX of the erasable toner X is 120° C. In addition, the standby temperature is the same temperature as the fixing temperature TX of the lower temperature between the fixing temperature TK and the fixing temperature TX.

Figure 4:
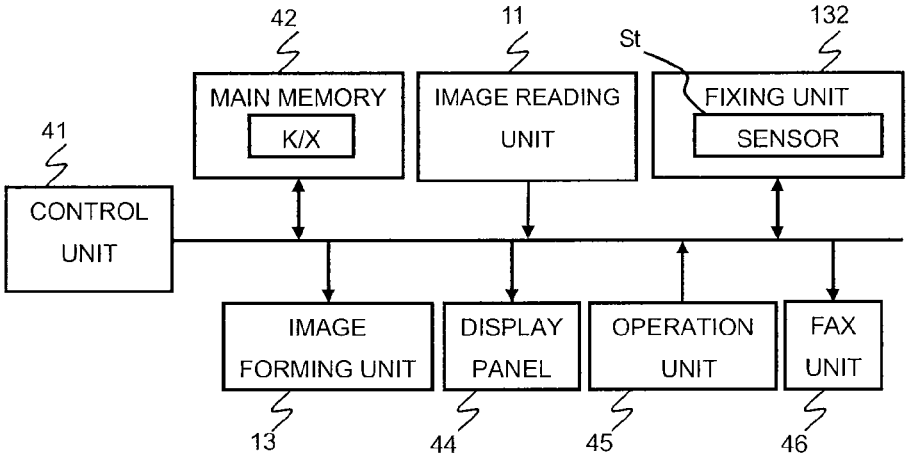
FIG. 4 is a block diagram illustrating a control system of the image forming apparatus according to the first embodiment.

FIG. 4 is a block diagram illustrating a control system of the MFP 100. As illustrated in FIG. 4, the MFP 100 includes a control unit 41, a main memory 42, an image forming unit 13, an image reading unit 11, a display panel 44, an operation unit 45, a FAX unit 46, and the like. The control unit 41 controls the image forming unit 13, the fixing unit 132, and the like based on an operation condition of the MFP 100 designated by the user through the operation unit 45, to perform an image forming process. The control unit 41 further controls each of the units to perform various processes such as an image reading process by the image reading unit 11.

The control unit 41 identifies the process unit 14 provided in the MFP 100. The control unit 41 identifies the process unit 14, for example, when the process unit 14 is detached from the MFP 100 by the user and then the process unit 14 is provided again in the MFP 100 by the user. In addition, the control unit 41 may have a configuration of identifying the process unit 14 when the power is turned on by the user. The MFP 100 includes a detection unit (not illustrated) that detects detachment and installation of the process unit 14 by the user. The control unit 41 reads the authentication data stored in the process unit 14 to identify the process unit 14.

The authentication data includes data about the kind of toner and data about the fixing temperature. The control unit 41 determines the kind of toner and the fixing temperature of the toner provided in the MFP 100 based on the read authentication data. For example, the control unit 41 determines that the toner provided in the MFP 100 is the normal toner K and the erasable toner X. In addition, the control unit 41 determines the fixing temperature TK of the normal toner K and the fixing temperature TX of the erasable toner X in the printing mode.

The authentication data is not limited to the data. The authentication data includes, for example, data about the kind of toner, and the MFP 100 may have a configuration of storing the fixing temperature data in advance according to the kind of toner. In this case, the control unit 41 determines the kind of toner from the authentication data, and determines the fixing temperature corresponding to the kind of toner with reference to the fixing temperature data stored in advance.

The control unit 41 determines the fixing temperature TK of the normal toner K and the fixing temperature TX of the erasable toner X, and sets the fixing temperature TX lower than the fixing temperature TK to the target temperature of the fixing unit 132 of the warming-up mode and the standby temperature of the fixing unit 132 of the standby mode.

When the image forming process is performed by the image forming unit 13, the control unit 41 operates the process unit 14 for the toner designated by the user through the operation unit 45. In addition, the control unit 41 controls the temperature of the fixing unit 132. The temperature control of the fixing unit 132 will be further described later.

The control unit 41 executes a program stored in the main memory 42 to perform the image forming process or the like. The control unit 41 may be a central processing unit (CPU), a micro processing unit (MPU) that can perform an operation process equivalent to that of the CPU, or the like. A part or all of the functions provided in the MFP 100 may be realized by an application specific integrated circuit (ASIC) as a processor.

The main memory 42 stores a program for executing the image forming process and the processes based on the MFP 100. The main memory 42 temporarily stores image data generated by an RIP process in the image forming process, or provides a work area of various applications. In addition, the main memory 42 temporarily stores a signal of an image forming work acquired through a network (not illustrated), or an operation input signal from the operation unit 45. The main memory 42 stores the fixing temperatures TK and TX of the normal toner K and the erasable toner X determined by the control unit 41, for example, as illustrated in FIG. 3.

The main memory 42 may be configured from, for example, a random access memory (RAM), a read only memory (ROM), a dynamic random access memory (DRAM), a static random access memory (SRAM), a video RAM (VRAM), a flash memory, and the like. The MFP 100 includes an auxiliary memory that stores various kinds of information in addition to the main memory 42. The auxiliary memory may be a hard disk drive (HDD), a flash memory, a solid state drive (SSD), and a magnetic disk other than the HDD.

The display panel 44 displays various kinds of information such as setting information and an operation situation of the MFP 100. For example, the display panel 44 displays the normal toner K and the erasable toner X provided in the MFP 100 as a user usable toner. The display panel 44 may be configured from an electronic paper, a liquid crystal display (LCD), an electronic luminescence (EL), a plasma display panel (PDP), or the like. The display panel 44 is configured by a touch panel display, and thus the display panel 44 may also serve as a part or all of the functions of the operation unit 45 to be described later.

The operation unit 45 receives an instruction about an operation condition of the MFP 100 from the user. For example, the operation unit 45 receives a designation about an image formation condition for a print or copy operation from the user. The user may designate any toner between the erasable toner X and the normal toner K as the image formation condition. As for the designation of the toner, the user may simply select the kind of toner in the operation unit 45. In addition, as for the designation of the toner, the user may select a printing method, for example, whether the printing method is a reuse printing (printing using the erasable toner X) method of reusing a sheet after printing or a normal printing (printing using the normal toner K) method. In addition, the user may perform the designation of the toner for each page in the operation unit 45 when a copy or print target original is formed of a plurality of pages. In addition, the designation of the toner may be performed on each arbitrary portion of the original designated by the user in the operation unit 45.

In addition, the operation unit 45 receives a condition about a scanning operation and a condition about FAX (for example, a FAX number or the like). The operation unit 45 may be configured from, for example, a start key, an input key of numerals or the like, a keyboard, a mouse, a touch panel, a touch pad, a pen tablet, a dedicated button, and the like. The FAX unit 46 is a device that transmits and receives a signal of a facsimile through the network.

By the configuration described above, the MFP 100 may perform printing using any toner between the normal toner K and the erasable toner X. For example, when the operation unit 45 receives the designation of the toner by the user and receives an operation of the start key, the control unit 41 controls the image reading unit 11, the image forming unit 13, and the like. The image reading unit 11 acquires the image data of the original. The image forming unit 13 performs the image forming operation using the toner designated by the user based on the image data acquired by the image reading unit 11.

Specifically, when the erasable toner X is designated by the user, the erasable toner process unit 14 forms the image of the erasable toner X on the photoreceptor drum 13*x*. When the normal toner K is designated by the user, the normal toner process unit 14 forms the image of the normal toner K on the photoreceptor drum 13*k*. The transfer belt 131 transfers the image of the toner formed by the process unit 14 onto the sheet Sa or the sheet Sb. The fixing unit 132 fixes the image of the toner transferred onto the sheet. The sheet discharge unit 15 accumulates the sheet on which the image of the toner is fixed and which is discharged out of the MFP 100.

Figure 5:
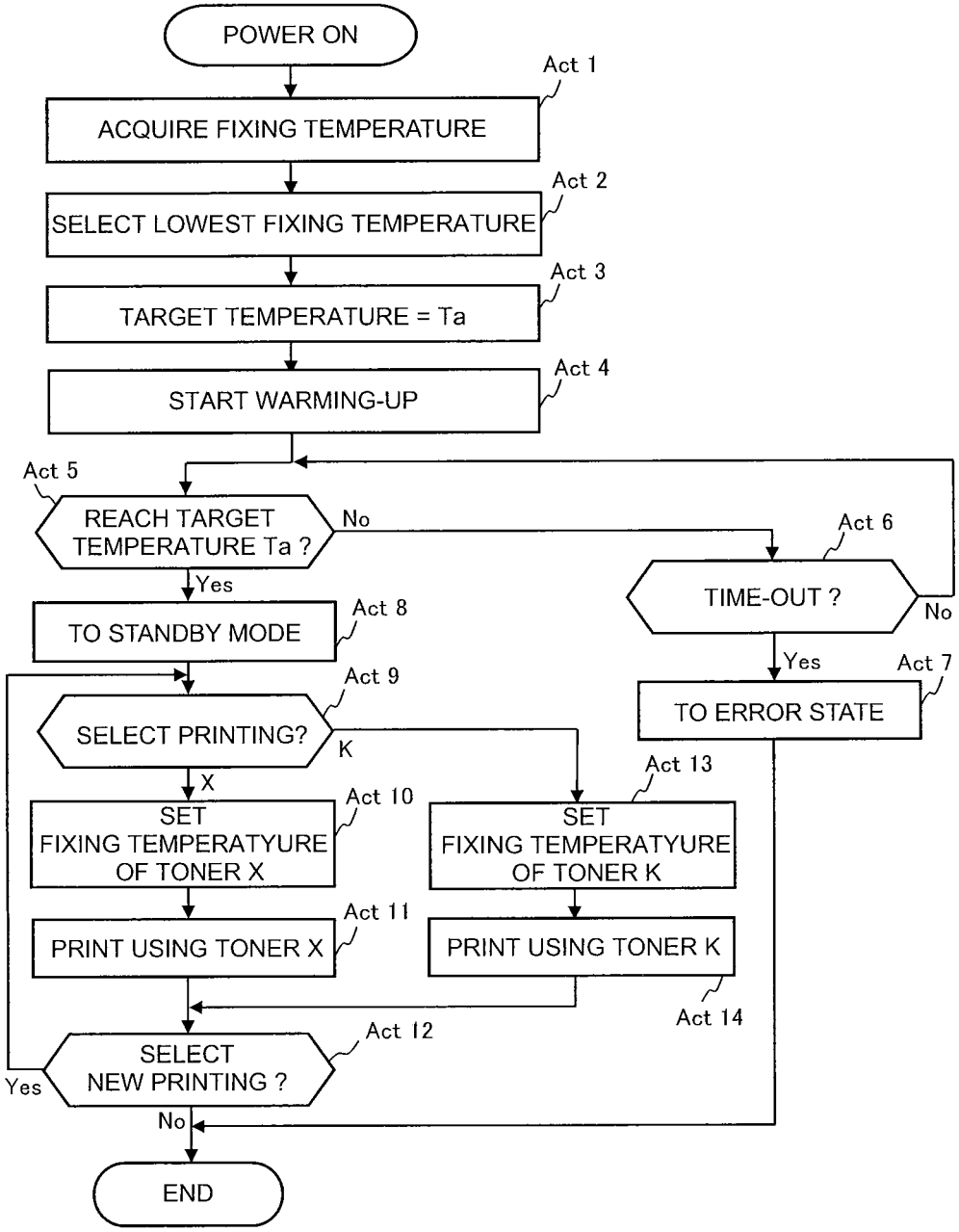
FIG. 5 is a flowchart illustrating a control operation of the image forming apparatus according to the first embodiment.

FIG. 5 is a flowchart illustrating a control operation of the MFP 100 according to the first embodiment. A control operation of the MFP 100 when the printing is performed using any toner between the normal toner K and the erasable toner X in a state where the MFP is provided with the normal toner K and the erasable toner X will be described hereinafter.

As illustrated in FIG. 5, when the power is turned on by the user, the control unit 41 acquires the fixing temperatures of the normal toner K and the erasable toner X provided in the MFP 100 from the main memory 42 in Act 1.

In Act 2, the control unit 41 selects the lowest fixing temperature Ta from the acquired fixing temperatures. As illustrated in FIG. 3, the fixing temperature Ta is the fixing temperature TK (=120° C.) of the erasable toner X.

In Act 3, the control unit 41 sets the target temperature of the fixing unit 132 in the warming-up mode to the fixing temperature Ta. The target temperature is the same temperature as the standby temperature of the fixing unit 132.

In Act 4, the control unit 41 turns on the heater of the fixing unit 132 to start heating of the heat roller 132*a*. The MFP 100 starts the warming-up mode. In the warming-up mode, the control unit 41 displays a message for notifying the user that the MFP 100 is warming up, for example, a message of "Please wait" on the display panel 44.

In Act 5, the control unit 41 determines whether or not the temperature of the heat roller 132*a* reaches the target temperature Ta (=the fixing temperature Ta) based on the temperature detection information of the temperature sensor St. When the control unit 41 determines that the temperature of the heat roller 132*a* does not reach the target temperature Ta, the operation of the MFP 100 proceeds to Act 6.

In Act 6, the control unit 41 determines whether or not a preset time has elapsed (time-out). When the control unit 41 determines that the preset time has not elapsed (No), the operation of the MFP 100 returns to Act 5. When the control unit 41 determines that the preset time has elapsed (Yes), the operation of the MFP 100 proceeds to Act 7.

In Act 7, the control unit 41 determines that an abnormal state occurs, and ends the warming-up mode. The abnormal state is, for example, a state where the fixing unit 132 is abnormal and the temperature of the heat roller 132*a* does not reach the target temperature Ta. The control unit 41 displays a message for notifying the user that the abnormal state occurs in the MFP 100 or a message for notifying the user that the MFP 100 needs to be maintained, on the display panel 44.

In Act 5, when the control unit 41 determines that the temperature reaches the target temperature Ta (Yes), the operation of the MFP 100 proceeds to Act 8. As illustrated in FIG. 3, the target temperature Ta is the same temperature as the lowest fixing temperature TX, and thus it is possible to shorten the time of reaching the target temperature Ta (=the standby temperature).

In Act 8, the MFP 100 ends the warming-up mode, and transfers to the standby mode. In the standby mode, the control unit 41 keeps the temperature of the heat roller 132*a* at the standby temperature=120° C. Since the standby temperature is the same temperature as the lowest fixing temperature TX, it is possible to suppress power consumption of the MFP 100 in the standby mode. In the standby mode, the control unit 41 displays a message for notifying the user that the MFP 100 is printable, for example, a message such as "Ready", "Copiable", or "Printable", on the display panel 44. As described above, since it is possible to shorten the time of reaching the target temperature Ta (=the standby temperature) of the warming-up mode, it is possible to display the message for notifying the user of the printable state without taking a time after the MFP 100 is powered on by the user.

In Act 9, the control unit 41 determines whether the operation unit 45 receives the printing instruction of the normal toner K from the user or the operation unit 45 receives the printing instruction of the erasable toner X from the user. In Act 9, when the control unit 41 determines that the operation unit 45 receives the printing instruction based on the erasable toner X, the operation of the MFP 100 proceeds to Act 10.

In Act 10, the control unit 41 sets the temperature of the heat roller 132*a* of the fixing unit 132 to the fixing temperature TX=120° C. of the erasable toner X. In a case of printing using the erasable toner X, the fixing temperature TX of the fixing unit 132 is the same temperature as the standby temperature. After the control unit 41 confirms that the fixing temperature TX and the standby temperature Tare the same temperature, the operation of the MFP 100 proceeds to Act 11. Since the fixing temperature TX of the fixing unit 132 is the same temperature as the standby temperature, no time is needed for the MFP 100 to start the printing using the erasable toner X from the standby mode. Accordingly, the standby time for the user does not occur.

In Act 11, the control unit 41 controls the image forming unit 13 and the like to perform the image forming operation based on the erasable toner X. In addition, the control unit 41 controls the fixing unit 132 to perform the fixing operation. The fixing unit 132 fixes the image of the erasable toner X on the sheet at the fixing temperature TX. When the sheet discharge unit 15 accumulates the sheet after the fixing, the printing operation based on the erasable toner X is ended, and the operation of the MFP 100 proceeds to Act 12.

In Act 9, when the control unit 41 determines that the operation unit 45 receives the printing instruction based on the normal toner K, the operation of the MFP 100 proceeds to Act 13. In Act 13, the control unit 41 sets the temperature of the fixing unit 132 to the fixing temperature TK=160° C. of the normal toner K. In a case of printing using the normal toner K, the fixing temperature TK is higher than the standby temperature (=120° C.), and thus the control unit 41 turns on the heater to heat the heat roller 132*a*. A time t1 (see FIG. 6) to raise the temperature of the heat roller 132*a* to 160° C. is necessary, but it is possible to shorten the time t1 by a heating method. Accordingly, it is possible to shorten the time until the MFP 100 starts the printing using the normal toner K from the standby mode to the extent that the user does not feel waiting. When the temperature of the heat roller 132*a* is raised to 160° C., the operation of the MFP 100 proceeds to Act 14.

In Act 14, the control unit 41 controls the image forming unit 13 and the like to perform the image forming operation based on the normal toner K. In addition, the control unit 41 controls the fixing unit 132 to perform the fixing operation. The fixing unit 132 fixes the image of the normal toner K on the sheet at the fixing temperature TK. When the sheet discharge unit 15 accumulates the sheet after the fixing, the printing based on the normal toner K is ended, and the operation of the MFP 100 proceeds to Act 12.

In Act 12, the control unit 41 determines whether or not the operation unit 45 receives a new printing instruction of the user. When the control unit 41 determines that the operation unit 45 receives the new printing instruction of the user (Yes), the operation of the MFP 100 returns to Act 9, and the process of Act 9 and the subsequent processes thereof are performed. When the control unit 41 determines that the operation unit 45 does not receive the new printing instruction of the user (No), the printing operation of the MFP 100 is ended. After the printing operation is ended, the control unit 41 controls the temperature of the fixing unit 132 to be the standby temperature (=the fixing temperature TX) so that the operation of the MFP 100 is in the standby mode.

Figure 6:
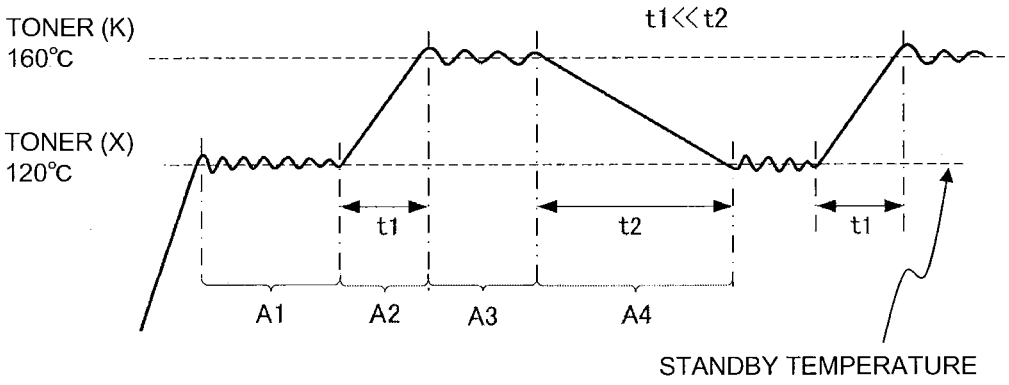
FIG. 6 is a diagram illustrating a temperature of the fixing unit in each operation mode of the image forming apparatus according to the first embodiment.

FIG. 6 is a diagram illustrating a temperature control of the fixing unit 132 in each operation mode of the MFP 100. Specifically, FIG. 6 illustrates a temperature control of the fixing unit 132 in a case of transferring from the power-on of the MFP 100 to the standby mode through the warming-up mode, then transferring from the standby mode to the printing mode using the normal toner K, then transferring to the standby mode, and then transferring from the standby mode to the printing mode using the normal toner K again.

In FIG. 6, an area before an area A1 corresponds to the temperature control in the warming-up mode from Act 4 to Act 5. In the warming-up mode, the temperature of the heat roller 132*a* is raised from the temperature lower than the standby temperature (=120° C.) for the standby temperature (=120° C.) as the target temperature.

The area A1 of FIG. 6 corresponds to the temperature control in the standby mode from Act 8 to Act 9. In the standby mode, the temperature of the heat roller 132*a* reaches the target temperature (=the standby temperature), and is kept at the standby temperature. In the first embodiment, the standby temperature (=120° C.) is the same as the fixing temperature TX (=120° C.). Accordingly, the area A1 corresponds to the temperature control in the operation from Act 9 to Act 11 (the operation when transferring to the printing mode using the erasable toner X).

An area A2 of FIG. 6 corresponds to the temperature control in the operation of Act 13 (the operation while transferring from the standby mode to the printing mode using the normal toner K). The temperature of the heat roller 132*a* is raised from the standby temperature (=120° C.) to the fixing temperature TK (=160° C.) to transfer from the standby mode to the printing mode using the normal toner K. In FIG. 6, the time necessary to raise the temperature of the heat roller 132*a* is t1. As described above, it is possible to shorten the time t1 by the heating method of the heat roller 132*a*.

An area A3 of FIG. 6 is an area of the printing mode using the normal toner K of Act 14. The temperature of the heat roller 132*a* reaches the fixing temperature TK (=160° C.), and is kept at the fixing temperature TK.

An area A4 of FIG. 6 corresponds to, for example, the temperature control when transferring from the printing mode using the normal toner K to the standby mode, when the control unit 41 determines that the operation unit 45 does not receive the new printing instruction of the user in Act 12 (No) after the printing using the normal toner K of Act 14 is performed. In addition, the area A4 of FIG. 6 corresponds to, for example, the temperature control when transferring from the printing mode using the normal toner K to the printing mode using the erasable toner X, when the control unit 41 determines that the operation unit 45 receives the new printing instruction of the user in Act 12 (Yes) and then the control unit 41 determines that the operation unit 45 receives the printing instruction based on the erasable toner X in Act 9 after the printing based on the normal toner K is performed in Act 14.

In the area A4 of FIG. 6, the temperature of the heat roller 132*a* is lowered from the fixing temperature TK (=160° C.) of the normal toner K to the standby temperature (or the fixing temperature TX of the erasable toner X) 120° C. In FIG. 6, the time necessary to lower the temperature of the heat roller 132*a* is t2. In order to lower the temperature of the heat roller 132*a*, the control unit 41 turns off the heater of the heat roller 132*a*. In addition, it is possible to lower the temperature of the heat roller 132*a* using a cooling unit such as a cooling fan (not illustrated). However, since it is difficult for the time t2 to be equal to or shorter than the time t1, the time t2 is longer than the time t1. Accordingly, when there is a printing request using the erasable toner X of the user through the operation unit 45 after the printing using the normal toner K is performed, the control unit 41 displays a message for notifying the user that the MFP 100 is not printable, for example, a message of "Please wait", on the display panel 44.

Next, an MFP 100 according to a second embodiment will be described. The MFP 100 according to the second embodiment has the same configuration as that of the MFP 100 according to the first embodiment except for setting of the target temperature (=the standby temperature) in the warming-up mode. Specifically, similarly to the first embodiment, the MFP 100 according to the second embodiment is an image forming apparatus which is provided with an erasable toner X (the fixing temperature TX=120° C.) and a normal toner K (the fixing temperature TK=160° C.) and can perform printing using the erasable toner X or the normal toner K. The standby temperature is a temperature closer to the fixing temperature TX than the fixing temperature TK, and is a temperature lower than the fixing temperature TX.

Figure 7:
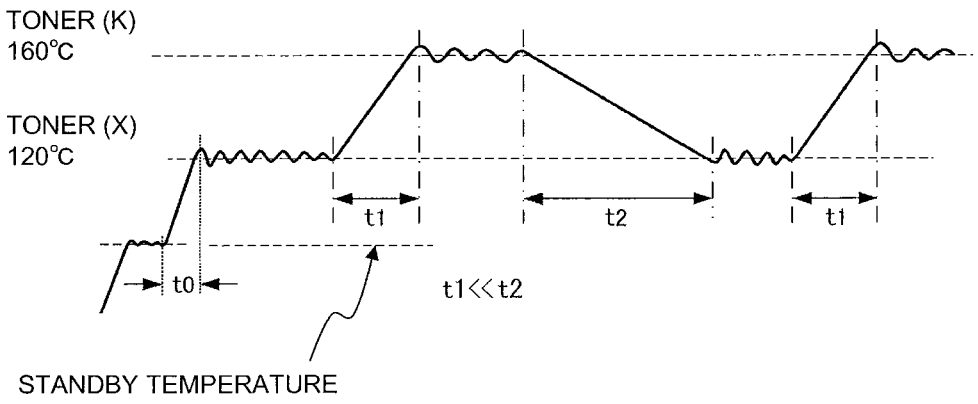
FIG. 7 is a diagram illustrating a temperature of a fixing unit in each operation mode of an image forming apparatus according to a second embodiment.

FIG. 7 is a diagram illustrating a temperature control of the fixing unit 132 in each operation mode of the MFP 100 according to the second embodiment. Specifically, FIG. 7 illustrates the temperature of the fixing unit 132 in a case of performing the printing using the erasable toner X from the standby mode, then performing the printing using the normal toner K, then performing the printing using the erasable toner X, and then performing the printing using the normal toner K.

As illustrated in FIG. 7, the standby temperature is a temperature lower than the fixing temperature TK (=160° C.) of the normal toner K and the fixing temperature TX (=120° C.) of the erasable toner X. Accordingly, also when the printing using the erasable toner X as well as the printing using the normal toner K is performed, the control unit 41 raises the temperature of the fixing unit 132 from the standby temperature to the fixing temperature of the erasable toner X. In this case, a time t0 is necessary. Specifically, in Act 10 of FIG. 5, the temperature of the fixing unit 132 is set to the fixing temperature TX=120° C. of the erasable toner X. Since the fixing temperature TK (=120° C.) of the erasable toner X is higher than the standby temperature, the control unit 41 turns on the heater to heat the heat roller 132*a*, thereby raising the temperature of the heat roller 132*a* to the fixing temperature TK. It is possible to shorten the time t0 to the extent that the user does not feel the standby time by the setting of the standby temperature. In addition, in the MFP 100 of the second embodiment, it is possible to lower the standby temperature than that of the first embodiment, and thus it is possible to further suppress power consumption of the standby mode.

Figure 8:
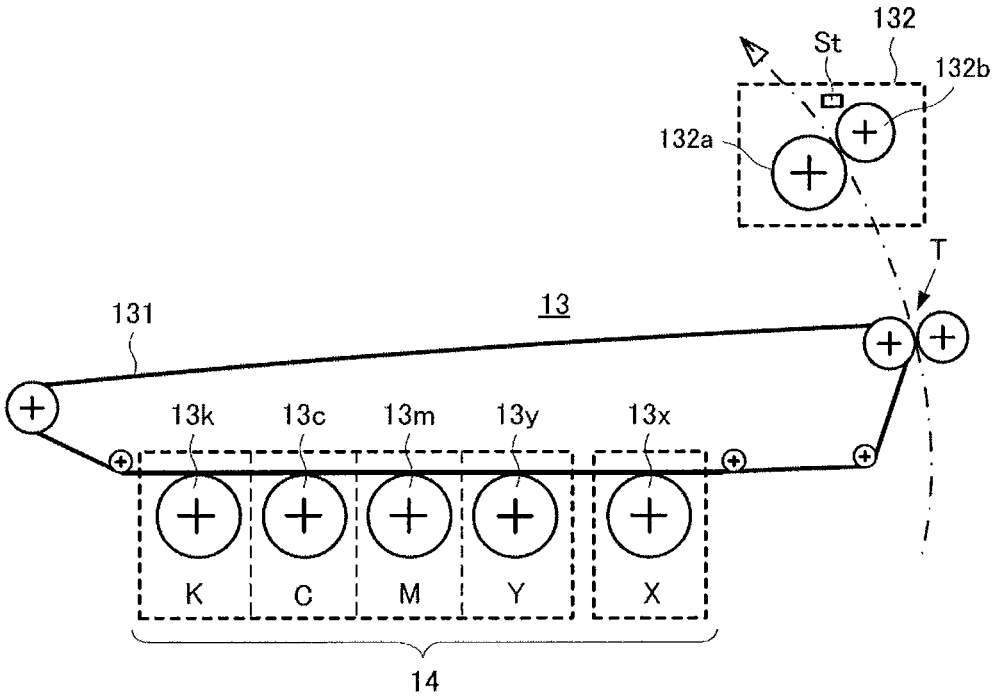
FIG. 8 is an enlarged diagram illustrating a part of an image forming apparatus according to a third embodiment.

Next, an MFP 100 according to a third embodiment will be described. The MFP 100 of the third embodiment has the same configuration as that of the MFP 100 according to the first embodiment except that a plurality of normal toners are provided. Specifically, the MFP 100 of the third embodiment is an image forming apparatus that is provided with an erasable toner X and normal toners K such as a black toner BK, a cyan toner C, a magenta toner M, and a yellow toner Y, and can perform color printing using the normal toners. FIG. 8 is an enlarged diagram illustrating a part of the MFP 100 of the third embodiment. As illustrated in FIG. 8, the MFP 100 includes four toner process units that accommodates the black toner BK, the cyan toner C, the magenta toner M, and the yellow toner Y and have photoreceptor drums 13*k*, 13*c*, 13*m*, and 13*y* for toners, respectively, in addition to a process unit 14 and a process unit for the erasable toner X.

FIG. 9 is a diagram illustrating a relation between the fixing temperature (the temperature of the fixing unit 132 in the printing mode) of each toner and the standby temperature. As illustrated in FIG. 9, the fixing temperature TX of the erasable toner X is 120° C., the fixing temperatures TK of the toners BK, C, M, and Y are 160° C. Since the toners BK, C, M, and Y have different fixing temperature characteristics, temperatures necessary for fixing are different from one another. Accordingly, the fixing temperatures of the toners BK, C, M, and Y may be changed to each other. However, in a case of color printing, the toners BK, C, M, and Y are targets to be fixed simultaneously, and thus the fixing temperatures (the temperature of the fixing unit 132 in the printing mode) TK of the toners BK, C, M, and Y are set to the same temperature (=160° C.). The fixing temperature TK is a temperature Tat which all the toners BK, C, M, and Y can be fixed. Similarly to the first embodiment, the standby temperature is set to the temperature same as the lowest fixing temperature TX (=120° C.) between the fixing temperature TK and the fixing temperature TX.

Next, an MFP 100 according to a fourth embodiment will be described. The MFP 100 according to the fourth embodiment has the same configuration as those of the other embodiments except for setting of the standby temperature (=the target temperature in the warming-up mode). Specifically, similarly to the other embodiments, the MFP 100 according to the fourth embodiment is an image forming apparatus that is provided with an erasable toner X (a fixing temperature TX=120° C.) and a normal toner K (a fixing temperature TK=160° C.) and can perform printing using the erasable toner X or the normal toner K. The standby temperature is a temperature higher than the fixing temperature TX and lower than the fixing temperature TK. In addition, the standby temperature is a temperature closer to the fixing temperature TX than the fixing temperature TK (for example, 125° C.±several degrees).

In the fourth embodiment, a temperature difference between the standby temperature and the fixing temperature TK of the normal toner K is smaller than those of the other embodiments. Accordingly, when the printing using the normal toner is performed from the standby mode, it is possible to shorten the time necessary to raise the temperature of the heat roller 132*a* from the standby temperature to the fixing temperature TK. In addition, it is possible to suppress power consumption for raising the temperature of the heat roller 132*a* from the standby temperature to the fixing temperature TK. Meanwhile, when the printing using the erasable toner X is performed from the standby mode, it is necessary to lower the temperature of the fixing unit 132 from the standby temperature to the fixing temperature TX. Accordingly, the MFP 100 needs the time for lowering the temperature from the standby temperature to the fixing temperature TX. However, since the difference between the standby temperature and the fixing temperature TX is small, it is possible to shorten the time to lower the temperature of the fixing unit 132.

As described above, the MFP 100 according to the embodiment is the image forming apparatus provided with the plurality of toners of which the fixing temperatures are different, and the standby temperature (=the target temperature of the warming-up mode) is set to the temperature closer to the lowest fixing temperature than the highest fixing temperature among the fixing temperatures of the toners. Accordingly, it is possible to shorten the time of the warming-up mode until transferring to the standby mode after the MFP 100 is powered on. Accordingly, it is possible display a message of a printable state on the display panel within a short time after the power is turned on. In addition, it is possible to suppress standby power in the standby mode.

In the embodiments described above, although the fixing temperature TX of the erasable toner X is 120° C. and the fixing temperature TK of the normal toner K is 160° C., the fixing temperature is not limited thereto. The fixing temperatures of the erasable toner X and the normal toner K may be changed according to materials constituting toners.

In addition, although the image forming apparatus has been described as the apparatus provided with a kind of erasable toner, a plurality of kinds of erasable toners may be provided. In addition, although the image forming apparatus has been described as the apparatus provided with the erasable toner and the normal toner, the image forming apparatus may be an apparatus provided with only a plurality of kinds of erasable toners of which fixing temperatures are different, and may be an apparatus provided with only a plurality of kinds of normal toners of which fixing temperatures are different.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an operation unit configured to receive an instruction for an image forming operation;

an image forming unit configured to store a non-erasable toner and an erasable toner, and form an image on a recording medium using any one of the non-erasable toner and the erasable toner when the instruction for the image forming operation is received by the operation unit;

a fixing unit configured to fix the image formed by the image forming unit on the recording medium at a fixing temperature and wait at a standby temperature after the apparatus is powered on and before the instruction for the image forming operation is received by the operation unit; and a control unit configured to set the fixing temperature to a first temperature when the image of the non-erasable toner is fixed, set the fixing temperature to a second temperature that is lower than the first temperature when the image of the erasable toner is fixed, and set the standby temperature to a third temperature that is lower than the second temperature and higher than the room temperature, until the instruction for the image forming operation is received by the operation unit after the apparatus is powered on.

2. The image forming apparatus according to claim 1, wherein the first non-erasable toner is a cyan toner, a magenta toner, a yellow toner, or a black toner.

3. The image forming apparatus according to claim 2, wherein the operation unit receives an instruction to use one of the non-erasable toner and the erasable toner when the image forming operation is performed.

4. The image forming apparatus according to claim 2, wherein the image forming unit includes a process unit that stores the non-erasable toner and a process unit that stores the erasable toner, and each unit stores data of the stored toner.

5. The image forming apparatus according to claim 4, wherein the control unit is further configured to acquire the first temperature and the second temperature from the data of the toners stored in the process units.

6. The image forming apparatus according to claim 2, wherein the control unit acquires information about the first temperature and the second temperature from information of the toner stored in a storage unit when the apparatus is powered on.

* * * * *